US010799742B1

(12) United States Patent
Chen

(10) Patent No.: US 10,799,742 B1
(45) Date of Patent: Oct. 13, 2020

(54) STRAP SPRING TRAMPOLINE

(71) Applicant: Samuel Chen, Causeway Bay (CN)

(72) Inventor: Samuel Chen, Causeway Bay (CN)

( * ) Notice: Subject to any disclaimer, the term of this patent is extended or adjusted under 35 U.S.C. 154(b) by 44 days.

(21) Appl. No.: 16/374,423

(22) Filed: Apr. 3, 2019

(51) Int. Cl.

| | |
|---|---|
| ***A63B 5/11*** | (2006.01) |
| ***A63B 21/02*** | (2006.01) |
| *A63B 5/00* | (2006.01) |
| *A63B 71/00* | (2006.01) |

(52) U.S. Cl.
CPC ..... *A63B 5/11* (2013.01); *A63B 21/025* (2013.01); *A63B 5/00* (2013.01); *A63B 71/0054* (2013.01); *A63B 2071/009* (2013.01); *A63B 2225/62* (2013.01)

(58) Field of Classification Search
CPC ..... A63B 5/11; A63B 5/00; A63B 21/025; A63B 6/00; A63B 6/02; A63B 6/025; A63B 71/0054; A63B 2071/009
See application file for complete search history.

(56) References Cited

U.S. PATENT DOCUMENTS

| | | | | |
|---|---|---|---|---|
| 3,677,368 | A | 7/1972 | Green | |
| 4,037,834 | A * | 7/1977 | Oaks | A63B 69/0035 482/27 |
| 5,336,135 | A | 8/1994 | Keyvani | |
| 6,846,271 | B2 * | 1/2005 | Publicover | A63B 5/11 182/139 |
| 7,568,997 | B2 * | 8/2009 | Publicover | A63B 5/11 482/27 |
| 9,492,698 | B2 * | 11/2016 | Andon | A63B 21/026 |
| 10,029,133 | B2 * | 7/2018 | Miller | A63B 21/026 |
| 10,124,198 | B2 * | 11/2018 | Haggerty | A63B 71/0054 |
| 2017/0001054 | A1 * | 1/2017 | Liu | A63B 5/11 |
| 2018/0093120 | A1 * | 4/2018 | Chen | A63B 71/023 |
| 2019/0030386 | A1 * | 1/2019 | Seaman | A63B 21/00072 |
| 2020/0206554 | A1 * | 7/2020 | Wang | A63B 5/11 |

* cited by examiner

*Primary Examiner* — Megan Anderson
(74) *Attorney, Agent, or Firm* — Clement Cheng

(57) ABSTRACT

A strap spring trampoline includes a trampoline frame having an upper horizontal trampoline frame and a lower horizontal trampoline frame. A trampoline bed is extended across the upper horizontal trampoline frame. A strap connection is formed on the trampoline bed that connects the trampoline bed to a tension strap. A spring is connected to the tension strap and the lower horizontal trampoline frame. The spring is preferably helical. The trampoline leg rigidly connects between the upper horizontal trampoline frame and the lower horizontal trampoline frame. The upper horizontal trampoline frame has a horizontal extension, and the horizontal extension further includes a flat section. A spool sleeve fits over the upper horizontal trampoline frame, and a tension strap rides over the spool sleeve when the tension strap moves over the upper horizontal trampoline frame. A right collar and a left collar fit together and retain the spool sleeve.

8 Claims, 9 Drawing Sheets

STRAP SPRING TRAMPOLINE

FIELD OF THE INVENTION

The present invention is in the field of trampolines.

DISCUSSION OF RELATED ART

A variety of interesting trampoline spring mechanisms have been made in the prior art, for example as seen in inventor Hiroshi Kosuke Japanese patent 3993997 issued Oct. 17, 2007 and published Jul. 30, 2002, entitled Safety Trampoline, the disclosure of which is incorporated herein by reference. Kosuke described a safety trampoline having a soft edge on leaf springs that also form a bouncy flexible frame underneath a jump bed. In U.S. Pat. No. 3,677,368, by inventor Victor Green, issued Jul. 18, 1972, a trampoline frame is spring supported for additional bounce and safety. Also, in U.S. Pat. No. 5,336,135, issued Aug. 9, 1994 by inventor Daryoush Keyvani, and amusement apparatus includes a sequential number of trampolines that have a soft edge and include a variety of different spring mechanisms, the disclosure of which is included herein by reference.

SUMMARY OF THE INVENTION

A strap spring trampoline includes a trampoline frame having an upper horizontal trampoline frame and a lower horizontal trampoline frame. A trampoline bed is extended across the upper horizontal trampoline frame. A strap connection is formed on the trampoline bed that connects the trampoline bed to a tension strap. A spring is connected to the tension strap and the lower horizontal trampoline frame. The spring is preferably helical. The trampoline leg rigidly connects between the upper horizontal trampoline frame and the lower horizontal trampoline frame.

The upper horizontal trampoline frame has a horizontal extension, and the horizontal extension further includes a flat section. A spool sleeve fits over the upper horizontal trampoline frame, and a tension strap rides over the spool sleeve when the tension strap moves over the upper horizontal trampoline frame. A right collar and a left collar fit together and retain the spool sleeve. The spool sleeve rotates over the right collar and the left collar. The right collar and the left collar fit to the upper horizontal trampoline frame. A left spool protrusion is formed on the left collar and a right spool protrusion formed on the right collar. A left spool protrusion and a right spool protrusion form a spring cover gap between the spool sleeve and a spring cover.

The trampoline leg rigidly connects between the upper horizontal trampoline frame and the lower horizontal trampoline frame. The upper horizontal trampoline frame has a horizontal extension, wherein the horizontal extension further includes a flat section. The spring can be both helical and vertically oriented.

The following call out list of elements can be a useful guide in referencing the elements of the drawings.

21 Trampoline Bed
22 Upper Horizontal Trampoline Frame
23 Lower Horizontal Trampoline Frame
24 Trampoline Leg
25 Tension Strap
26 Trampoline Foot
27 Inward Middle Bend
28 Horizontal Frame Connection
29 Strap Connection
30 Horizontal Frame Sections
31 Horizontal Extension
32 Vertical Socket
33 Profile Portion
34 Socket Opening
35 Flat Section
40 Collar System
41 Right Collar
42 Left Collar
43 Right Spool Protrusion
44 Left Spool Protrusion
45 Right Locking Indent
46 Left Locking Tab
47 Right Locking Tab
48 Left Locking Indent
50 Spool Sleeve
60 Spring Cover
61 Lower Foam Layer
62 Upper Foam Layer
63 Spring Cover Shell
64 Spring Cover Gap
70 Enclosure
71 Zipper Entry
72 Net
73 Vertical Enclosure Pole
74 Horizontal Enclosure Pole
81 Blower Power Cord
82 Rib Sleeves
83 Flexible Ribs
84 Inflatable Shell
85 Blower Tube
86 Blower
87 Inflatable Bubble Enclosure
88 Vertical Spring
89 Ladder

DETAILED DESCRIPTION OF THE PREFERRED EMBODIMENT

Figure 1:
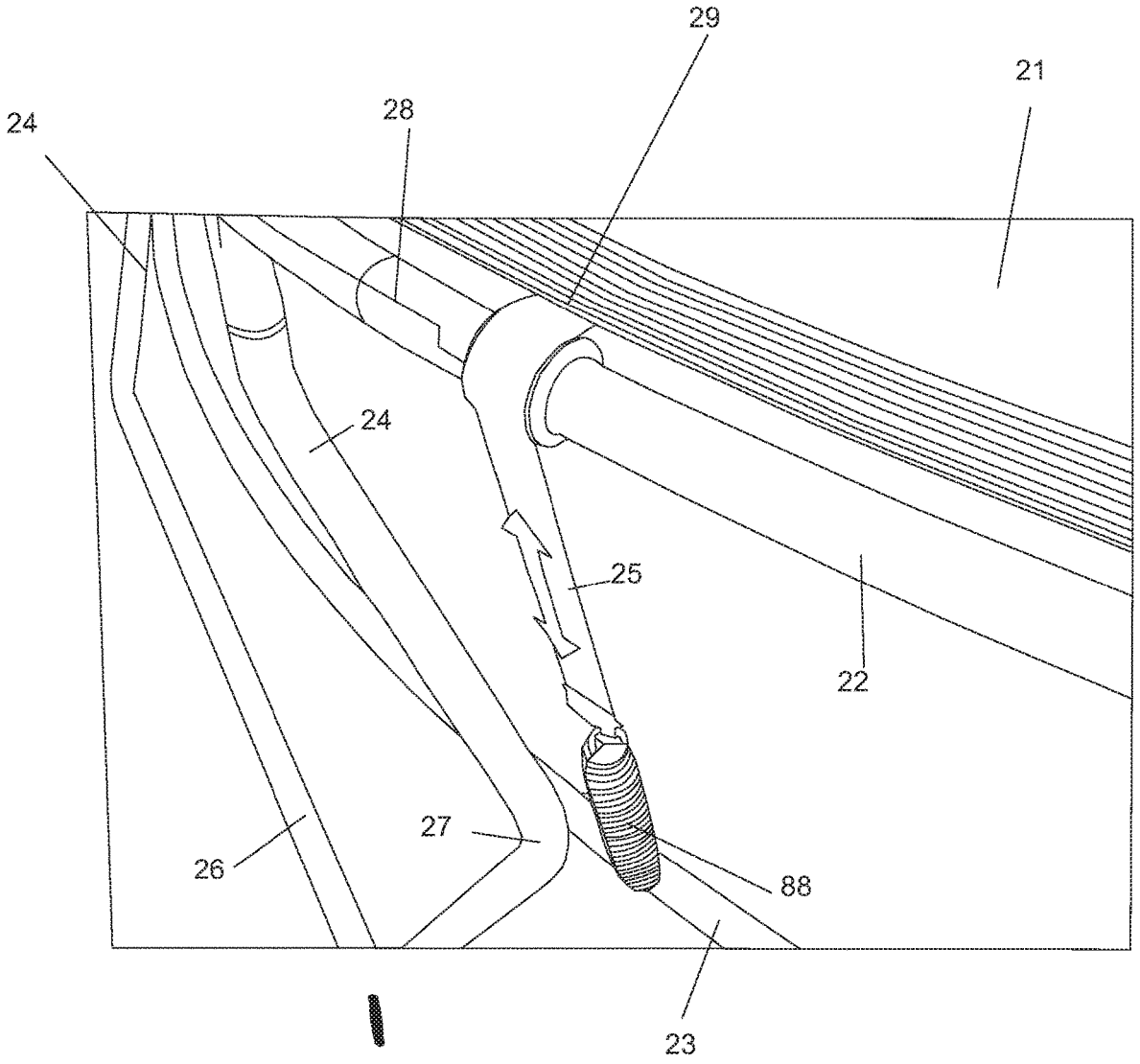
FIG. 1 is a perspective view of the strap spring mechanism.

As seen in FIG. 1, the trampoline has a trampoline bed 21 that users jump on. The trampoline bed 21 is connected to the strap connection 29 such as by stitching at a periphery of the trampoline bed 21. The horizontal frame connection 28 connects the upper horizontal trampoline frame 22 with other sections of the upper horizontal trampoline frame 22. The upper horizontal trampoline frame 22 also connects to the trampoline leg 24. The trampoline leg 24 has an inward middle bend 27 that can allow for a more flexible trampoline leg 24. The trampoline leg 24 has a trampoline foot 26 that rests upon the ground. The upper horizontal trampoline frame 22 can be reinforced by a lower horizontal trampoline frame 23, which can be connected to or near to the inward middle bend 27.

That tension strap 25 can be formed as a fabric strap that has ultraviolet resistance and slides over the upper horizontal trampoline frame 22. The tension strap 25 has a vertical portion and a horizontal portion. The horizontal portion of the tension strap 25 connects to the strap connection 29, and the vertical portion of the tension strap 25 connects to a vertical spring 88. The vertical spring 88 is preferably a helical spring that has a hardware connection to the tension strap 25 at an upper end of the helical spring. The lower end of the helical spring can connect to the lower horizontal trampoline frame 23. Thus, the trampoline bed 21 when biased downward increases a tension on the tension strap 25 which then pulls the vertical spring 88.

Figure 2:
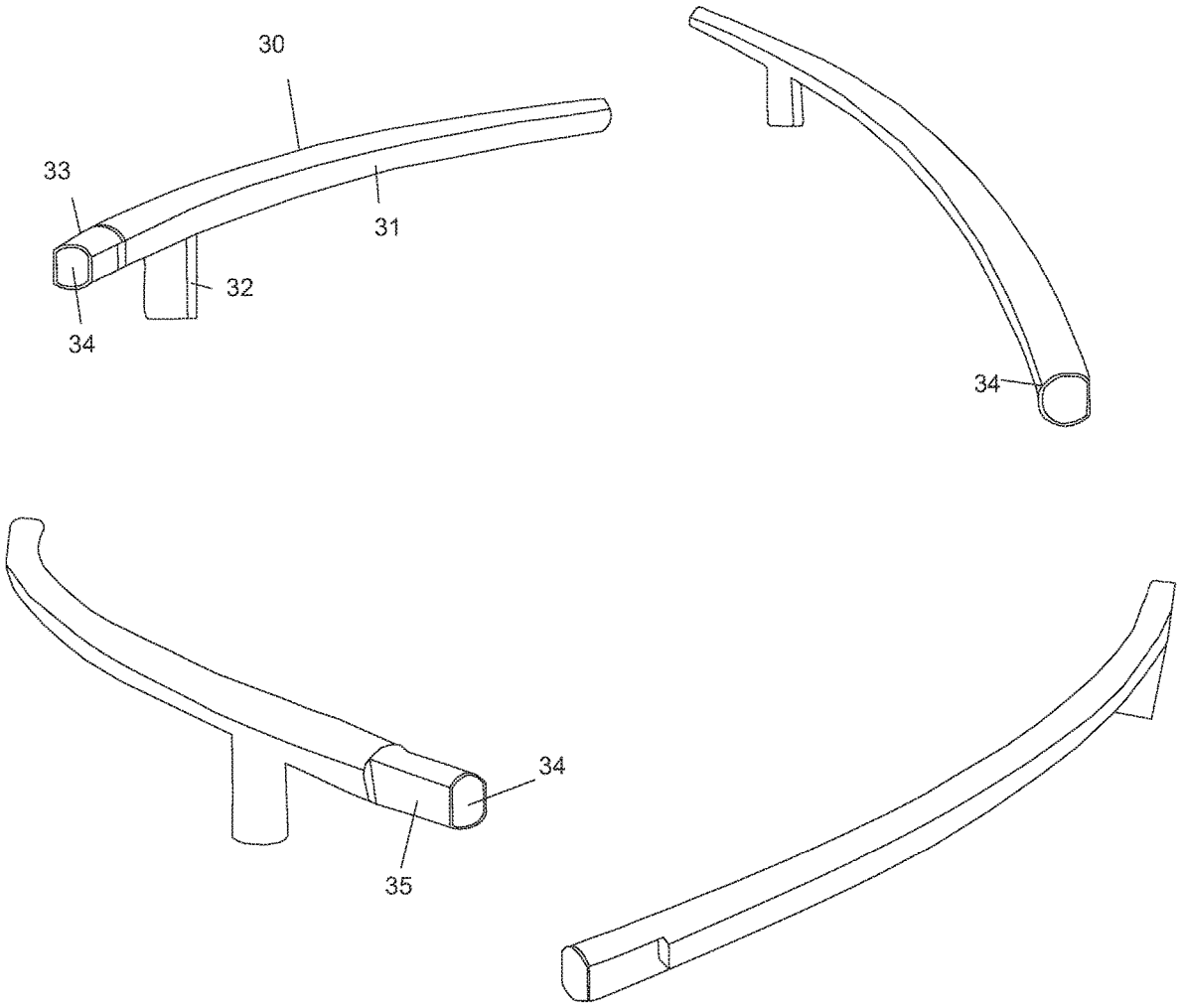
FIG. 2 is an exploded view of the present invention showing the profile portion of the horizontal frame sections.

As seen in FIG. 2, a variety of different horizontal frame sections 30 are shown as being able to fit together. The horizontal frame sections 30 each have a horizontal extension 31 that extends horizontally from a vertical socket 32. The vertical socket 32 connects to the trampoline leg 24. The horizontal extensions 31 connect to other horizontal extensions. The horizontal extensions 31 have a profile portion 33. The profile portions 33 are not circular in cross-section and have a flat section 35 near the socket opening 34. Each of the socket openings 34 meet with and connect with other socket openings 34 of other horizontal frame sections. There may be approximately eight horizontal frame sections 30 in one trampoline depending upon the size of the trampoline. Each of the profile portions 33 and each of the flat sections 35 connect together so that the trampoline frames do not rotate relative to each other during use. The tube of the horizontal frame sections can have a variety of different cross-sections that may have a flat section 35 on an external surface or on an internal side of the horizontal frame section 30.

Figure 3:
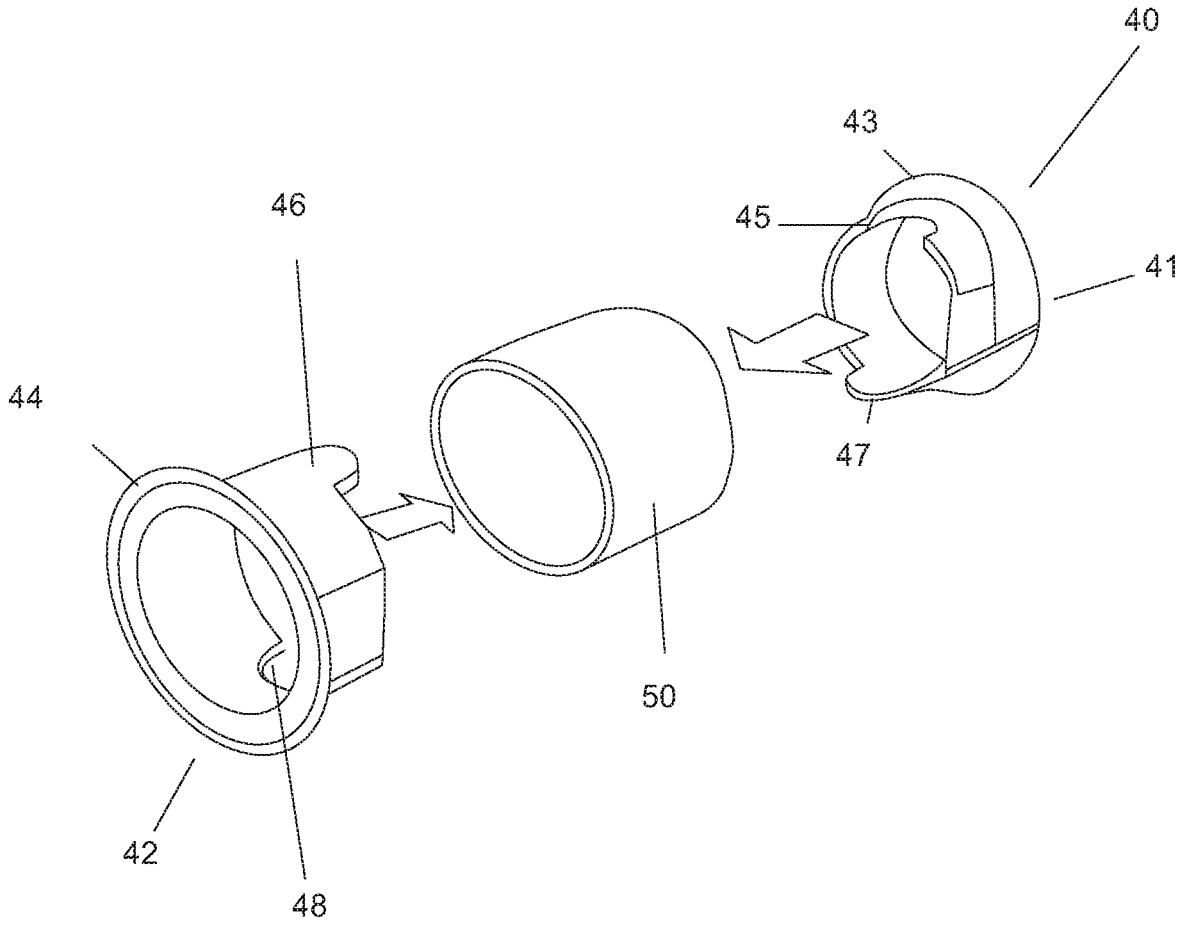
FIG. 3 is an exploded view assembly diagram showing assembly of the collar system.

As seen in FIG. 3, a collar system 40 includes a right collar 41 and a left collar 42. The right collar 41 and the left collar 42 can be formed of plastic injection molded parts. The right collar 41 and the left collar 42 can connect together. The right collar 41 can have a right locking tab 47 and the left collar 42 can have a left locking tab 46. The left locking tab 46 can fit to the right locking indent formed on the right collar 41. The right locking tab 47 formed on the right collar 41 can fit to the left locking indent 48 of the left collar 42. By connecting together with tabs and indents, the right and left collar are locked together. A spool sleeve 50 fits over the right collar 41 and the left collar 42. A right spool protrusion 43 and a left spool protrusion 44 are annular protrusions that retain the spool sleeve 50 in place. The right collar 41 and left collar 42 also have a flat portion that fits to the flat portion of the horizontal frame sections 30.

Figure 4:
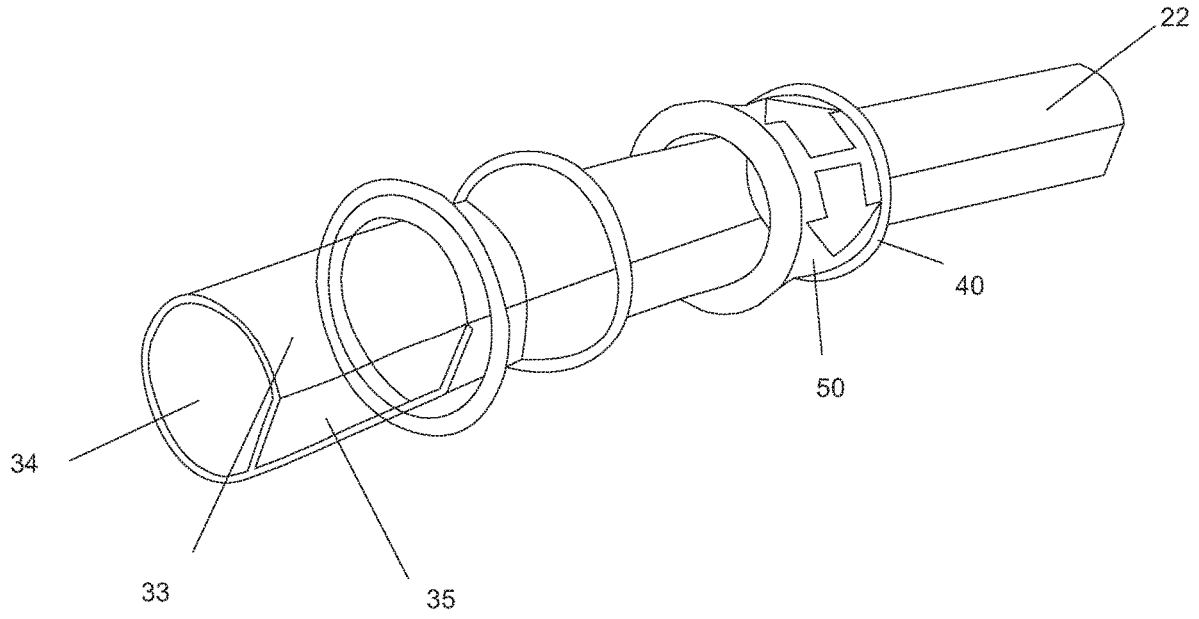
FIG. 4 is an assembly diagram showing assembly of the collar system.

As seen in FIG. 4, the meeting of the flat portions prevents rotation of the right collar and the left collar relative to the horizontal frame section. The tension strap 25 slips over the spool sleeve. The spool sleeve 50 can have a lubrication or have an internal surface made of a slippery material to decrease friction during use. The upper horizontal trampoline frame 22 can have a flat section 35 along the entire length of the upper horizontal trampoline frame 22. The flat section 35 can be on an inside surface facing the middle of the trampoline. The collar system fits over the flat section 35 and can optionally slide along the length of the flat section 35, or can be fixed to a set location on the upper horizontal trampoline frame 22. The socket opening 34 has a profile portion 33 that allows it to connect to other socket openings such as socket openings that are swaged to fit.

Figure 5:
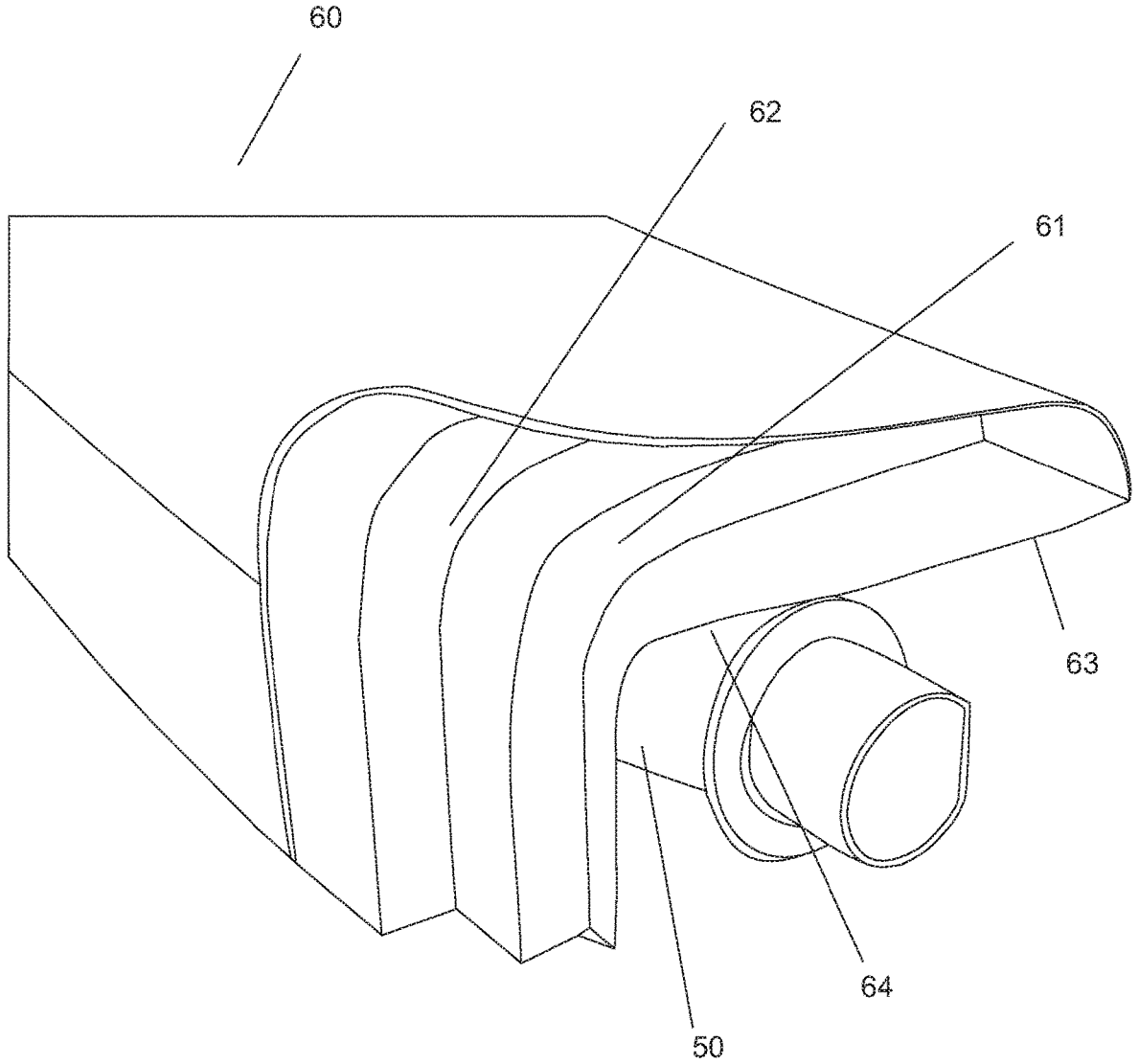
FIG. 5 is a perspective cross-section diagram of the spring cover installation.

As seen in FIG. 5, the spool sleeve 50 is held apart from the spring cover 30 by the left spool protrusion 44 and the right spool protrusion 43. The spool sleeve 50 does not touch the spring cover 60, especially when the spool sleeve 50 is rotating. The spring cover 60 has an upper foam layer 62 and a lower foam layer 61. The upper foam layer 62 and the lower foam layer 61 are encapsulated or held within a spring cover shell 63. The spool sleeve 50 and the spring cover 60 have a spring cover gap 64 between them.

Figure 6:
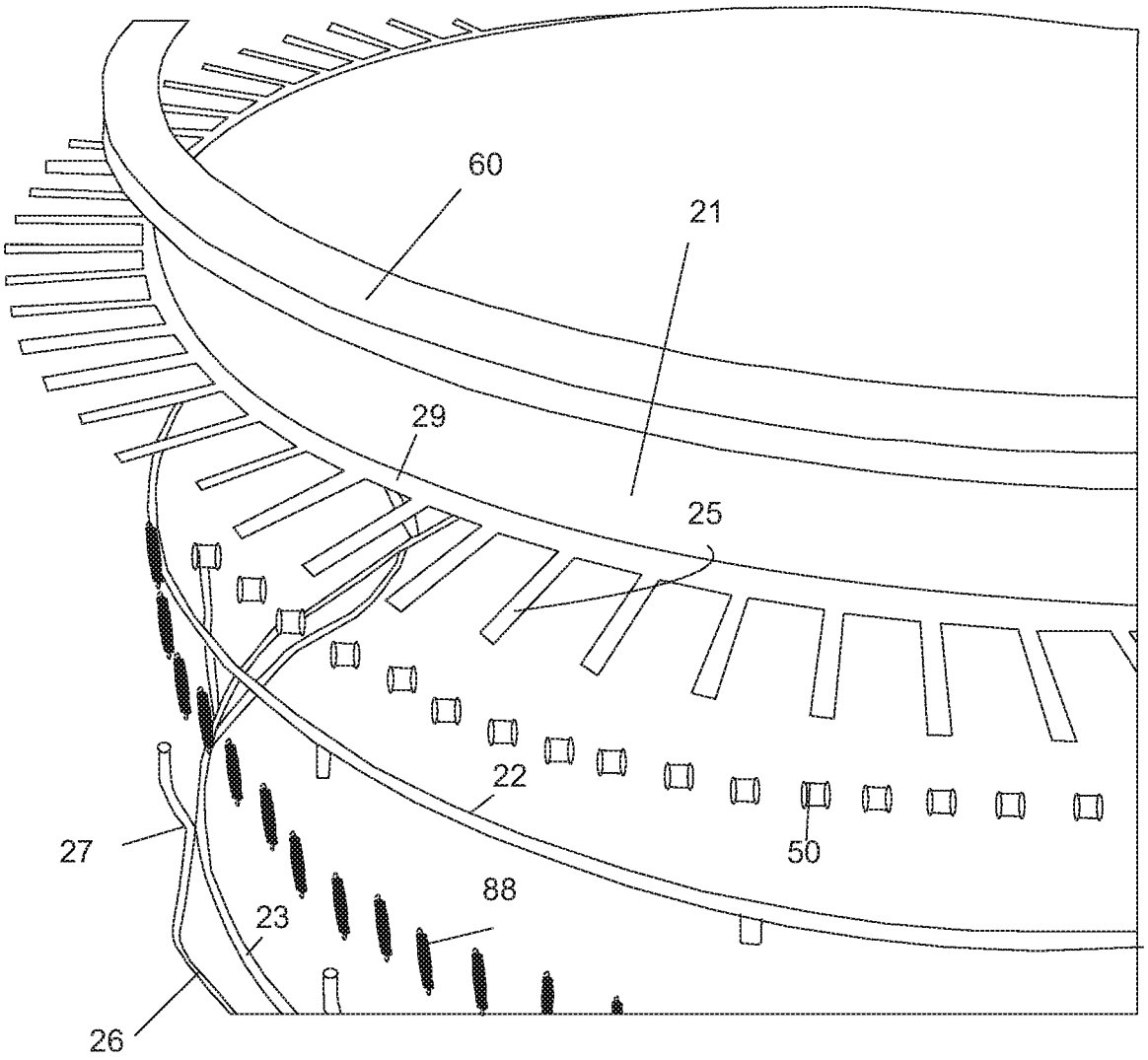
FIG. 6 is an exploded view diagram showing assembly of the strap spring trampoline.
Figure 7:
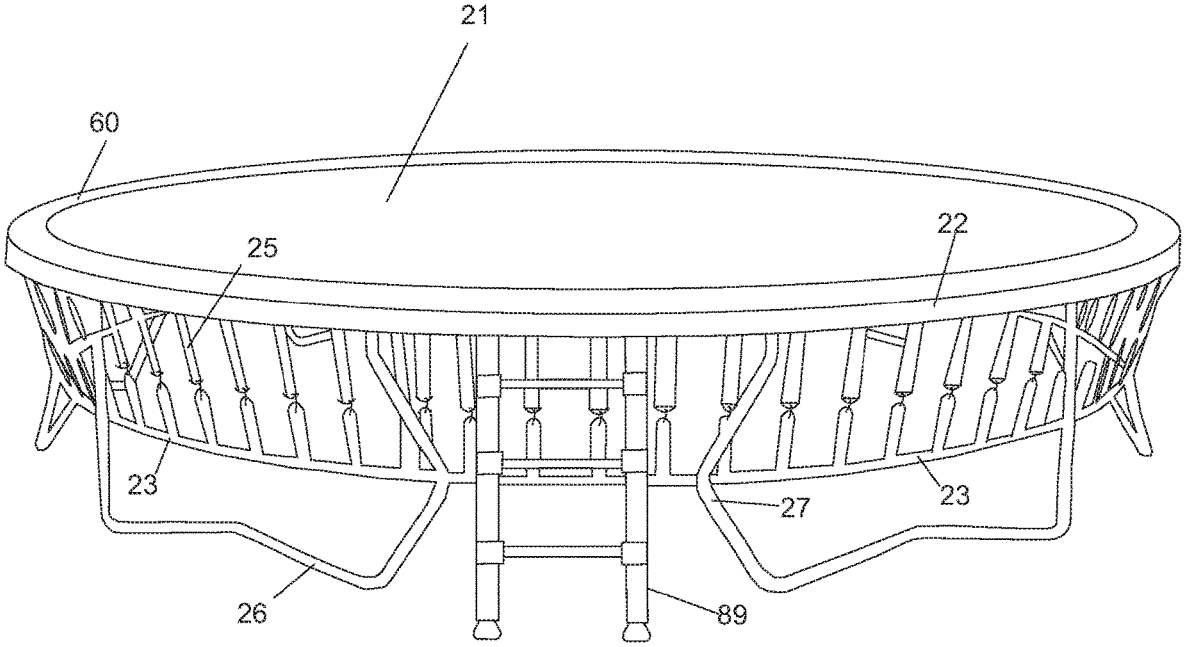
FIG. 7 is an assembled view of the present invention.

As seen in FIG. 6, the exploded view diagram shows a spring cover 60 fitting over the periphery of the trampoline bed 21. The strap connections 29 extend to a plurality of tension straps 25. The tension straps 25 roll over the spool sleeves 50. The tension straps 25 operate in tension to store rebound energy in a plurality of vertical springs 88. The vertical springs 88 are tensioned against a lower horizontal trampoline frame 23. The trampoline leg, the lower horizontal trampoline frame 23 and the upper horizontal trampoline frame 22 form a rigid frame for retaining the vertical springs 88. The trampoline leg has a trampoline foot 26 and may also include an inward middle bend 27 for increased flexibility As seen in FIG. 7, the trampoline includes a trampoline bed 21 with a spring cover 60 that fits over the periphery of the trampoline bed 21 without any exposed tension straps 25 on an upper surface of the trampoline bed 21. The trampoline leg has a trampoline foot 26 and an inward middle bend 27. The trampoline leg also helps support the frame and becomes a part of the frame. Optionally, a ladder 89 can be added to the frame.

Figure 8:
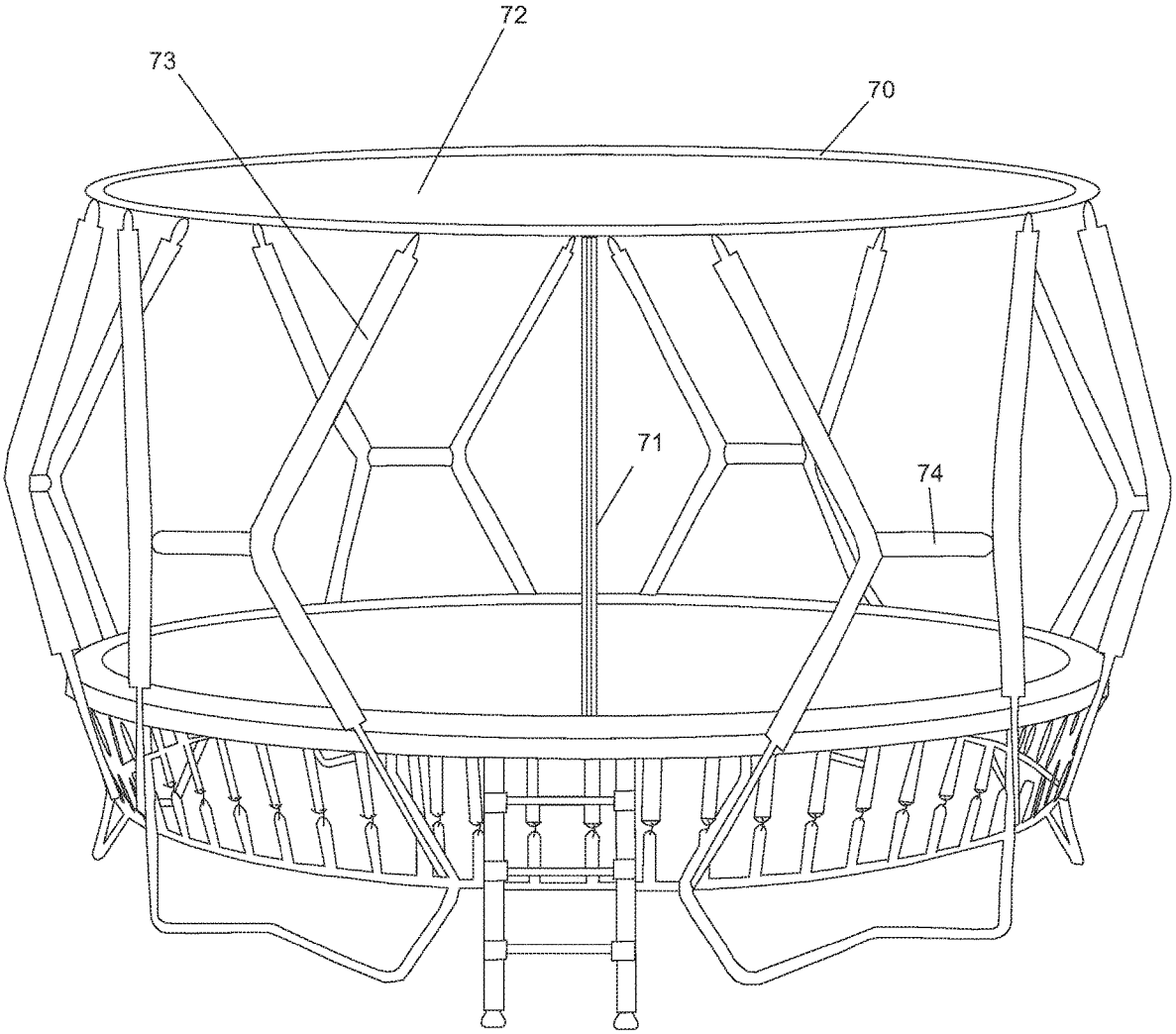
FIG. 8 is a front view of the assembled invention.
Figure 9:
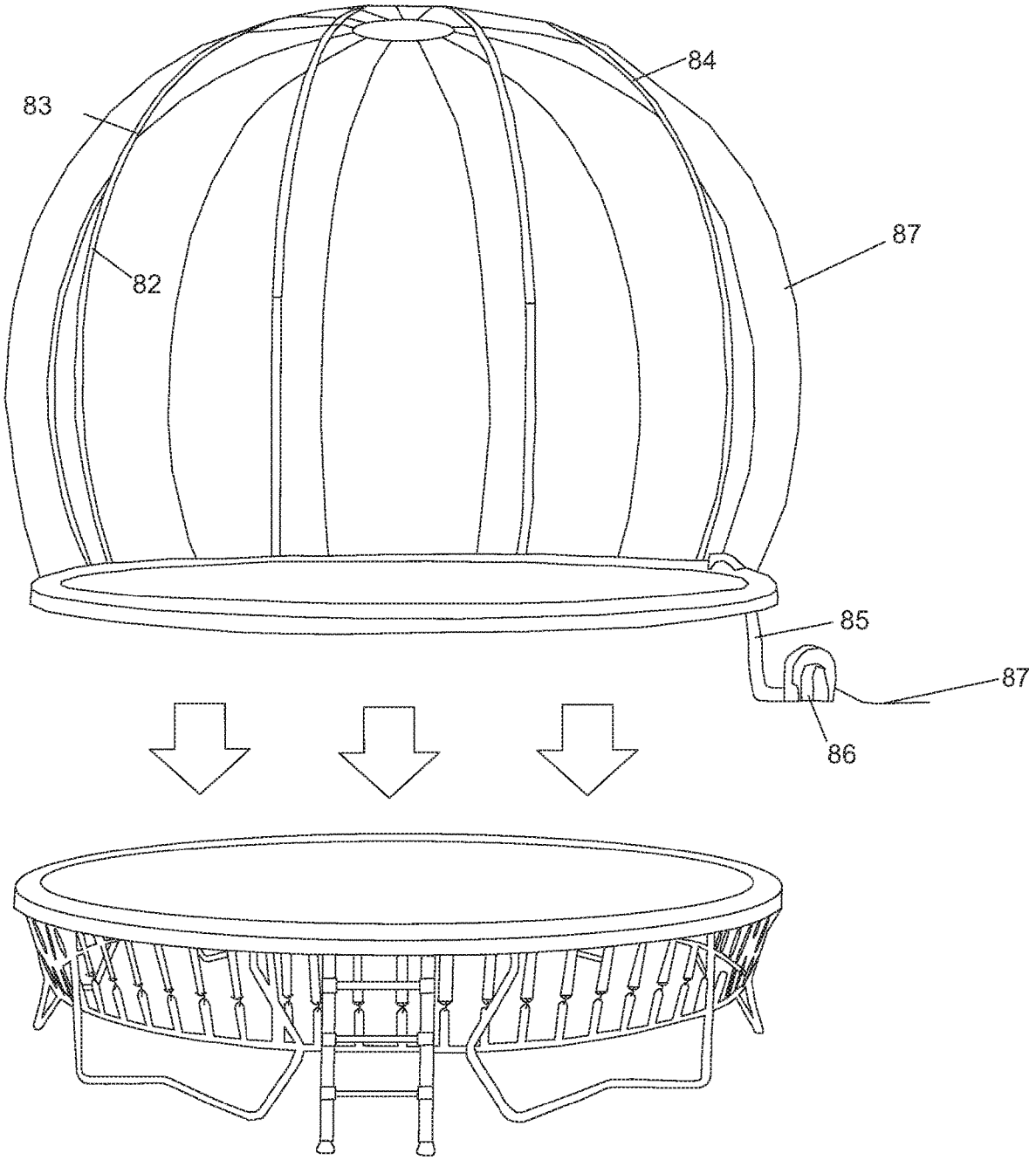
FIG. 9 is an exploded view of the present invention.

As seen in FIG. 8, the trampoline may have an enclosure 70 which includes a number of vertical enclosure poles 73 that support a net 72. The net may have a zipper entry 71 to form a doorway. For additional stability, the vertical enclosure poles 73 can be connected together via horizontal enclosure poles 74. Alternatively as seen in FIG. 9, the enclosure can be made as an inflatable. The inflatable enclosure includes an inflatable shell 84 that has rib sleeves 82 and flexible ribs 83. The flexible ribs 83 are inflated within the inflatable shell 84. The inflatable shell 84 forms an inflatable bubble enclosure 87 that can be inflated by a blower 86. The blower 86 is preferably powered by regular household current supplied such as by a blower power cord 81. The blower 86 pressurizes the inflatable bubble enclosure 87 via a blower tube 85.

The trampoline foot 26 is generally horizontal and can comprise a portion of the lower horizontal trampoline frame 23 such that the lower end of the vertical spring 88 can be connected to the trampoline foot 26. The strap is preferably a strip of fabric such as nylon webbing which is strong for high abrasion applications. For example, one-yard of 0.5" nylon webbing can be used for connecting the trampoline bed to the spring. The nylon webbing comes in a variety of different colors and can be color-coordinated to the trampoline bed. Polyethylene or polypropylene webbing can also be used for a variety of different indoor or outdoor applications. Preferably, the webbing is treated for moisture, UV and rot resistance.

The invention claimed is:

1. A strap spring trampoline comprising:

a. a trampoline frame having an upper horizontal trampoline frame, a trampoline leg and a lower horizontal trampoline frame;

b. a trampoline bed extended across the upper horizontal trampoline frame;

c. a strap connection formed on the trampoline bed that connects the trampoline bed to a tension strap;

d. a spring connected to the tension strap and the lower horizontal trampoline frame;

e. a spool sleeve fitting over the upper horizontal trampoline frame, wherein the tension strap rides over the spool sleeve when the tension strap moves over the upper horizontal trampoline frame; and f. a right collar and a left collar that fit together and retain the spool sleeve, wherein the spool sleeve rotates over the right collar and the left collar, wherein the right collar and the left collar fit to the upper horizontal trampoline frame.

2. The strap spring trampoline of claim 1, further including a left spool protrusion formed on the left collar and a right spool protrusion formed on the right collar.

3. The strap spring trampoline of claim 2, wherein the left spool protrusion and the right spool protrusion form a spring cover gap between the spool sleeve and a spring cover.

4. The strap spring trampoline of claim 3, wherein the spring is helical and vertically oriented.

5. The strap spring trampoline of claim 4, wherein the trampoline leg rigidly connects between the upper horizontal trampoline frame and the lower horizontal trampoline frame.

6. The strap spring trampoline of claim 4, wherein the upper horizontal trampoline frame has a horizontal extension, wherein the horizontal extension further includes a flat section.

7. The strap spring trampoline of claim 3, wherein the trampoline leg rigidly connects between the upper horizontal trampoline frame and the lower horizontal trampoline frame.

8. The strap spring trampoline of claim 3, wherein the upper horizontal trampoline frame has a horizontal extension, wherein the horizontal extension further includes a flat section.

* * * * *